United States Patent [19]

Plester et al.

[11] Patent Number: 4,549,469

[45] Date of Patent: Oct. 29, 1985

[54] HYDRAULIC RAM

[75] Inventors: Karl-Heinz Plester; Klaus-Dieter Reddig, both of Lunen; Heinz Hessel, Flaesheim, all of Fed. Rep. of Germany

[73] Assignee: Gewerkschaft Eisenhutte Westfalia, Lunen, Fed. Rep. of Germany

[21] Appl. No.: 548,405

[22] Filed: Nov. 3, 1983

[30] Foreign Application Priority Data

Nov. 9, 1982 [DE] Fed. Rep. of Germany ..... 3241237

[51] Int. Cl.[4] ..... F01B 31/12

[52] U.S. Cl. ..... 92/5 R; 91/1; 324/208

[58] Field of Search ..... 92/5 R; 91/1, DIG. 4; 324/208, 262

[56] References Cited

U.S. PATENT DOCUMENTS

| | | | |
|---|---|---|---|
| 3,364,361 | 1/1968 | Burger | 92/5 R |
| 3,956,973 | 5/1976 | Pomplas | 92/5 R |
| 4,053,826 | 10/1977 | Wasawa et al. | 324/208 |

FOREIGN PATENT DOCUMENTS

| | | | |
|---|---|---|---|
| 2348066 | 3/1975 | Fed. Rep. of Germany | 92/5 R |
| 2855681 | 6/1980 | Fed. Rep. of Germany | 92/5 R |
| 2106984 | 4/1983 | United Kingdom . | |

*Primary Examiner*—Robert E. Garrett
*Assistant Examiner*—Richard S. Meyer
*Attorney, Agent, or Firm*—Maurice E. Gauthier

[57] ABSTRACT

A hydraulic ram for use as an advance ram in mining operations has a plurality of permanent magnets embedded in its piston rod. At least one sensor is associated with a guide bush fixed to the piston rod end of the cylinder of the ram. The or each sensor is accommodated within a respective pocket formed in the guide bush. The pocket(s) can be closed off by a detachable closure member.

14 Claims, 2 Drawing Figures

HYDRAULIC RAM

BACKGROUND TO THE INVENTION

This invention relates to a hydraulic ram having a plurality of magnets embedded in its piston rod and sensing means associated with its cylinder. Hydraulic rams of this type are particularly useful as advance rams for longwall mineral mining installations.

A known type of hydraulic ram has a plurality of permanent magnets embedded in its piston rod, and a sensor fixed to its cylinder. The sensor incorporates an induction coil or a magnetic switch, and so senses the magnets as it passes over them during extension or retraction of the ram. Such a sensor will emit a control signal whenever a magnet is sensed, and these control signals can be used to measure a working stroke of the ram. Hydraulic rams of this type are used in particular for control purposes in longwall mineral mining installations. They serve, for example, for effecting a synchronisation (or follow-up control) of hydraulic rams such as, for example, the advance rams of mine roof support bar extensions of mine roof support units. (See U.S. Pat. No. 4,307,981).

When hydraulic rams of this type are used as advance rams for underground conveying and winning installations, the permanent magnets can also be used for measuring the distances through which the rams are extended or retracted, and therefore for measuring the advance of the installation. In this system, a row of magnets can be arranged on the piston rod, so that, when the advance stroke of the ram takes place, the magnets move in succession past the sensor (which is arranged at the end of the cylinder). In so doing, they provide electrical control signals which can be counted by an electronic counter which provides a measure of the advanced distance.

In a known hydraulic ram of this type, the permanent magnets are housed in metal bushes, each of which is held by a force-fit in a respective radial bore formed in the piston rod of the ram. The sensor, which is positioned on the end of the cylinder of the ram in alignment with the row of magnets, is a probe or switch, for example a magnetic or proximity switch, which is actuated as the permanent magnets move past it.

It has been proposed to arrange two or more rows of magnets on the piston rod of a hydraulic ram in such a way that the permanent magnets of one row are axially offset from those of the other row(s). (See DE-OS No. 3 137 951). In this arrangement, a separate probe or switch is provided for each row of magnets. Hydraulic rams of this type are particularly useful as hydraulic advance rams in underground mineral mining installations. The arrangement of the permanent magnets in several rows not only offers the possibility of spacing the magnets more widely from each other, and thus of suppressing reciprocal magnetic effects, but also renders it possible to preclude incorrect measurements from so-called "breathing" movements, that is to say movements resulting from a longwall conveyor being forced backwards towards the goaf side of a working by a passing winning machine such as a plough.

The aim of the invention is to provide an improved hydraulic ram of the type having a plurality of magnets embedded in its piston rod and sensing means associated with its cylinder.

SUMMARY OF THE INVENTION

The present invention provides a hydraulic ram having a piston rod reciprocable relative to a cylinder, the piston rod being provided with at least one permanent magnet, and the cylinder being provided with at least one sensor, wherein the or each sensor is accommodated in a respective pocket formed in the cylinder, and wherein the or each pocket is closed off by a detachable closure member.

Advantageously, the ram further comprises a guide bush attached to the piston rod end of the cylinder, the or each pocket being provided in the guide bush.

With this arrangement, the or each sensor is in a protected position in the interior of the guide bush, and is in close proximity to the piston rod, so that a reliable switching action is ensured. Moreover, the or each sensor is easily replaceable, owing to the provision of the detachable closure member.

Preferably, the or each pocket is open towards the piston rod. This helps to ensure a reliable switching action.

Advantageously, the or each pocket is provided in a thickened end portion of the guide bush. Preferably, the or each pocket is open towards a free end face of said end portion of the guide bush, and the detachable closure member is detachably fixed to said end face. This arrangement enables the or each sensor to be introduced into its pocket from the piston rod end of the cylinder in the direction of the axis of the piston rod, and for it to be secured in that pocket with the aid of the detachable closure member.

In a preferred embodiment, the or each pocket is provided with means for holding the respective sensor. Advantageously, the or each pocket is provided with an undercut base portion which engages with complementary projection means on the associated sensor, the undercut base portion(s) and the complementary projection means constituting said holding means.

Preferably, said end portion of the guide bush is of non-circular outline, having an extension which projects radially beyond the cylinder, the or each pocket being provided in said extension.

Advantageously, said end portion of the guide bush is provided with a respective duct for accommodating an electrical lead attached to the or each sensor, the or each duct extending from the pocket associated with the respective sensor to a common inlet duct formed in said end portion of the guide bush. Preferably, the or each duct is constituted by a channel formed in said end face of said end portion of the guide bush. Conveniently, an axially-extending bore is formed in said extension of said end portion of the guide bush, the axially-extending bore constituting the inlet duct. A coupling member may be provided within the axially-extending bore, the coupling member providing an electrical connection between the electrical lead of the or each sensor and an output lead attached to the coupling member.

Preferably, the closure member is a cover plate whose cross-section corresponds substantially to that of said end portion of the guide bush.

The hydraulic ram of the invention can be used with particular advantage as a hydraulic advance ram whose working stroke can be accurately controlled. In this case, at least two rows of permanent magnets are provided on the piston rod, each row having a plurality of longitudinally-spaced permanent magnets, and wherein two sensors are provided in the guide bush, the sensors being accommodated in respective pockets which are circumferentially offset by 90°.

In order to align the sensor(s) accurately with the rows of magnets associated with the piston rod, it is recommended that the guide bush be fixed relative to the cylinder by means of an alignment member. Preferably, the alignment member is a spring strip which is detachably held in a channel provided in the outer peripheral portion of said end portion of the guide bush, the spring strip being engageable in a channel formed in the cylinder.

BRIEF DESCRIPTION OF THE DRAWINGS

A hydraulic ram constructed in accordance with the invention will now be described, by way of example, with reference to the accompanying drawings, in which.

DESCRIPTION OF PREFERRED EMBODIMENT

Figure 1:
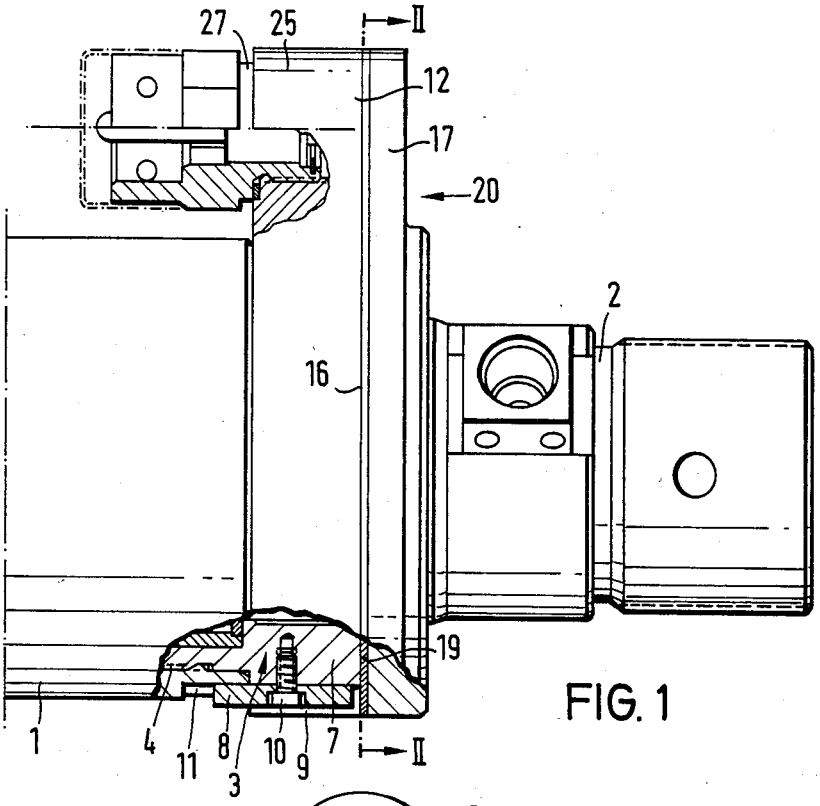
FIG. 1 is a part-sectional side elevation of the piston rod end of the hydraulic ram.

Referring to the drawings, FIG. 1 shows a hydraulic advance ram which is used for advancing a conveyor and/or a winning installation in an underground mine working. As is known, the advance ram may form part of the advance mechanism of a roof support unit. The ram is constituted by a cylinder 1, a piston (not shown) reciprocable within the cylinder, and a piston rod 2. A guide bush 3 is provided at the piston rod end of the cylinder 1, the guide bush having an external thread 4 which is screwed into an internal thread (not shown) formed at that end of the cylinder. The guide bush 3, which serves to guide the piston rod 2, is provided with an end seal and a wiper.

Figure 2:
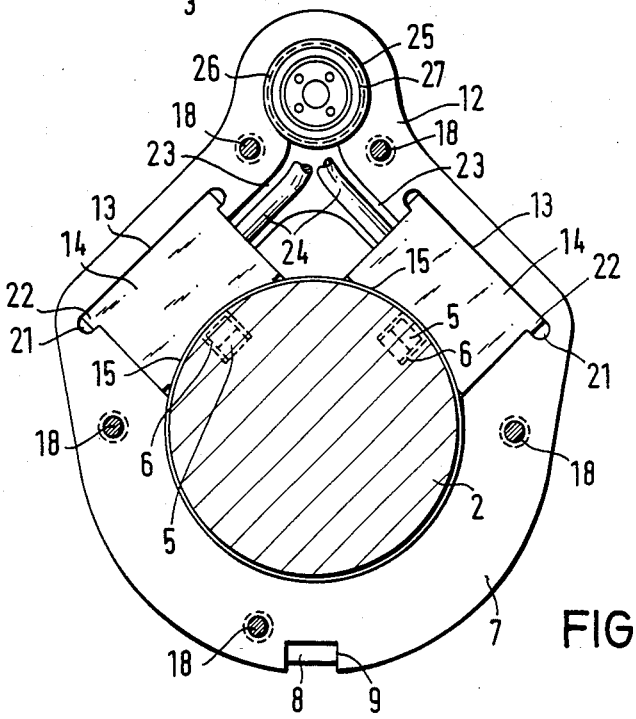
FIG. 2 is a cross-section taken on the line II—II of FIG. 1.

The piston rod 2 has two rows of permanent magnets 5 (two of which are shown in FIG. 2 by broken lines). The rows of magnets 5 are circumferentially offset from each other by 90°, and each row includes a plurality of axially spaced permanent magnets. The permanent magnets 5 are housed in metal bushes 6, which are force-fitted into radial bores drilled in the piston rod 2, the metal bushes terminating flush with the circular peripheral surface of the piston rod. The bushes 6 are preferably made of stainless, acid-resistant non-magnetic steel.

The guide bush 3 has a thickened end portion 7, which is disposed in front of the piston rod end of the cylinder 1. An alignment member 8 is provided for securing the guide bush 3 to the cylinder 1 in a predetermined angular position. The alignment member 8, which is constituted by a spring strip, is releasably held, by means of a screw 10, in a channel 9 formed in the outer periphery of the end portion 7 of the guide bush 3. The alignment member 8 engages in an axially-extending channel 11 provided at the end of the cylinder 1. When the screw 10 is loosened, the guide bush 7 may be rotated relative to the cylinder 1 to a desired position of adjustment. Thereafter, the screw is tightened, causing the end of the cylinder to be clamped between the alignment member 8 and the bush 7, thereby fixing the bush relative to the cylinder.

The end portion 7 of the guide bush 3 is of non-circular contour, being provided with a collar or extension 12. Two pockets 13 (see FIG. 2) are provided in the extension 12, each pocket accommodating a sensor 14 such as a magnetic or proximity switch. The pockets 13 are offset from each other by 90° in the direction of the periphery of the piston rod 2, so that the sensors 14 are aligned with the two rows of permanent magnets 5. The alignment member 8 holds the sensors 14 in precise alignment with the two rows of permanent magnets 5.

The ends 15 of the pockets 13 that are presented to the piston rod 2 are open, so that the sensors 14 are close to the piston rod. The ends of the pockets 13 adjacent to the outer periphery of the end portion 7 of the guide bush 3 are closed. The pockets 13 are open towards the outer end face 16 of the end portion 7 of the guide bush 3. The pockets 13 are closed at this end face 16 by a removable closure member 17. This closure member 17 is constituted by a cover plate whose outline corresponds to that of the end portion 7 of the guide bush 3. The cover plate 17 is detachably fixed to the end portion 7 by means of screws 18, a flat seal 19 being interposed between the cover plate and the end portion.

When the cover plate 17 is removed, the sensors 14 can be pushed into the pockets 13 in the direction indicated by the arrow 20. The sensors 14 have a shape which corresponds substantially to that of the pockets 13. The base 21 of each of the pockets 13 is undercut, so that each of the pockets is T-shaped. The sensors 14 are provided with outwardly-extending projections 22 which engage in the undercut bases 21, so that the sensors can be firmly secured in position in the pockets 13.

Ducts 23 are formed in the end portion 7 of the guide bush 3, the ducts accommodating electrical leads 24 connected to the sensors 14. The ducts 23 are channels formed in the end face 16 of the end portion 7, and are closed off by the cover plate 17. The extension 12 of the end portion 7 has an axial bore 26 which defines an inlet duct 25. The ducts 23 extend from the pockets 13 to the duct 25. A tubular coupling member 27 is screwed into the axial bore 26, and an electrical cable, which has a sheath accommodating leads connected to the leads 24, is connected to this tubular coupling member.

When the cover plate 17 is removed, the projections 22 of the sensors 14 can be introduced into the undercut bases 21 of the pockets 13 in the direction indicated by the arrow 20. At the same time, the leads 24 can be placed in the ducts 23, so that electrical connection of the sensors 14 with the coupling member 27 can be established. Then, with the flat seal 19 placed in position, the cover plate 17 can be secured to the end portion 7 of the guide bush 3 by the screws 18, so that the pockets 13 and the ducts 23 are closed off.

The pockets 13 expediently have a greater dimension in the circumferential direction of the piston rod 2 than in the radial direction of the piston rod, so that slight changes in the angle of rotation of the piston rod in relation to the cylinder 1 have no effect on the reliability of the switching action. Moreover, the piston rod 2 is prevented, by its attachment to part of the associated installation, from rotating excessively relative to the cylinder 1.

The hydraulic ram described above could be modified in a number of ways. For example, it would also be possible to provide only one pocket 13 (or more than two pockets) in the end portion 7 of the guide bush 3 for accommodating a corresponding number of sensors 14. In this case, the magnet system may comprise a single row of permanent magnets 5 (or more than two rows thereof). It is also possible to provide two permanent magnets on the piston rod 2 instead of one or more rows thereof, especially when only a final indication, showing the full outward and/or inward movement of the piston rod 2, is required.

We claim:

1. A hydraulic ram having a piston rod reciprocable relative to a cylinder, the piston rod projecting through one end of the cylinder and being provided with at least one permanent magnet, and the cylinder being provided with at least one sensor, wherein said at least one sensor is accommodated in a respective pocket formed in the cylinder, said pocket having a first opening facing in a first direction towards said piston rod and a second opening facing in a second direction parallel to the cylinder axis and through which said sensor is removably received, said pocket and said sensor having complimentary slidably engageable forms which serve both to guide the thus received sensor in said second direction into and out of a predetermined position in said pocket relative to the piston rod and to prevent said sensor from being withdrawn in said first direction from said predetermined position through said first opening, and wherein said second opening is closed off by a detachable closure member.

2. A hydraulic ram according to claim 1, further comprising a guide bush attached to said one end of the cylinder, said respective pocket being formed in the guide bush.

3. A hydraulic ram according to claim 2, wherein said complementary forms include an undercut base portion in said pocket which engages with complementary projection means on the sensor.

4. A hydraulic ram according to claim 2, wherein said respective pocket is formed in a thickened end portion of the guide bush.

5. A hydraulic ram according to claim 4, wherein said respective pocket is open towards a free end face of said thickened end portion of the guide bush, and the detachable closure member is detachably fixed to said end face.

6. A hydraulic ram according to claim 5, wherein said thickened end portion of the guide bush is of non-circular outline, having an extension which projects radially beyond the cylinder, said respective pocket being formed in said extension.

7. A hydraulic ram according to claim 6, wherein said thickened end portion of the guide bush includes a respective duct for accommodating an electrical lead attached to said at least one sensor, said at least one duct extending from the pocket associated with the respective sensor to a common inlet duct formed in said thickened end portion of the guide bush.

8. A hydraulic ram according to claim 7, wherein said at least one duct comprises a channel formed in said end face of said thickened end portion of the guide bush.

9. A hydraulic ram according to claim 7, wherein an axially-extending bore is formed in said extension of said thickened end portion of the guide bush, the axially-extending bore comprising the inlet duct.

10. A hydraulic ram according to claim 9, wherein a coupling member is positioned within the axially-extending bore, the coupling member providing an electrical connection between the electrical lead of said at least one sensor and an output lead attached to the coupling member.

11. A hydraulic ram according to claim 4, wherein the closure member is a cover plate whose cross-section corresponds substantially to that of said thickened end portion of the guide bush.

12. A hydraulic ram according to claim 2, wherein the piston rod includes at least two rows of permanent magnets, each row having a plurality of longitudinally-spaced permanent magnets, and wherein the guide bush includes two sensors, the sensors being accommodated in respective pockets which are circumferentially offset by 90°.

13. A hydraulic ram according to claim 4, wherein the guide bush is fixed relative to the cylinder at a predetermined angular setting by means of an alignment member.

14. A hydraulic ram according to claim 13, wherein the alignment member is a spring strip which is detachably held in a channel provided in the outer peripheral portion of said thickened end portion of the guide bush, the spring strip being engageable in a channel formed in the cylinder.

* * * * *